United States Patent [19]

Eraña

[11] Patent Number: 5,052,465

[45] Date of Patent: Oct. 1, 1991

[54] DRIVE MECHANISM FOR CORE RELEASE MACHINES

[76] Inventor: Agustin A. Eraña, Zorrostea, 4 Polg. Ind. Ali-Gobeo, 01010 Vitoria Alava, Spain

[21] Appl. No.: 472,774

[22] Filed: Jan. 31, 1990

[30] Foreign Application Priority Data

Feb. 10, 1989 [ES] Spain ..... 8900488

[51] Int. Cl.[5] ..... B22C 15/22

[52] U.S. Cl. ..... 164/201; 164/200

[58] Field of Search ..... 164/200, 202, 201

[56] References Cited

U.S. PATENT DOCUMENTS

| | | | |
|---|---|---|---|
| 2,656,575 | 10/1953 | Herbruggen | 164/201 |
| 2,793,409 | 5/1957 | Hansberg | 164/201 |
| 2,839,798 | 6/1958 | Hinrichs | 164/202 |
| 4,140,171 | 2/1979 | Michelson | 164/201 |
| 4,570,694 | 2/1986 | Lund | 164/202 |
| 4,766,771 | 8/1988 | Bailey | 164/203 |
| 4,794,976 | 1/1989 | Peterle | 164/201 |
| 4,807,690 | 2/1989 | Erana | 164/200 |

FOREIGN PATENT DOCUMENTS

| | | | |
|---|---|---|---|
| 596043 | 4/1960 | Canada | 164/202 |
| 128859 | 7/1950 | Fed. Rep. of Germany | 164/201 |
| 972225 | 6/1959 | Fed. Rep. of Germany | 164/201 |
| 1075776 | 10/1954 | France | 164/201 |
| 1237305 | 6/1986 | U.S.S.R. | 164/203 |

*Primary Examiner*—Richard K. Seidel
*Assistant Examiner*—Rex E. Pelto
*Attorney, Agent, or Firm*—Helfgott & Karas

[57] ABSTRACT

A release mechanism for driving a ram of a release mechanism of a core release machine comprises a threaded cylinder integral with the ram and a pin driven by a motor. The threaded cylinder is guided by a cylindrical sleeve positioned in a casing which houses the mechanism. The pin which is provided with a ball thread and imparting an axial movement to the threaded cylinder when the motor is in operative position, is supported in the casing above the threaded cylinder through axial and radial bearings. The motor for driving the pin is positioned in a lid of the casing.

3 Claims, 1 Drawing Sheet

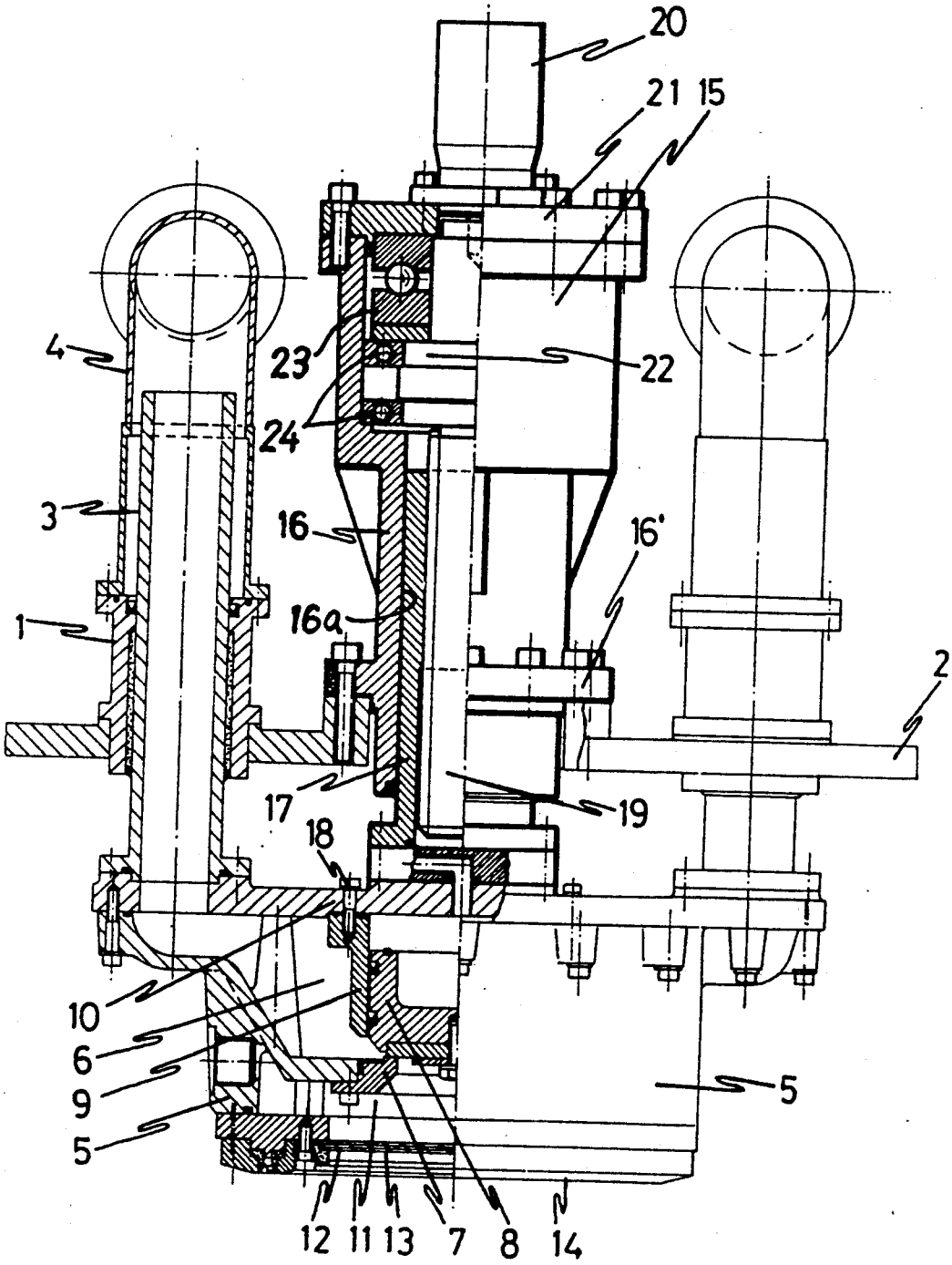
20
21
15
4
23
22
24
3
16
16'
16a
1
2
17
19
18
10
6
9
5
5
12
11
13
7
8
14

DRIVE MECHANISM FOR CORE RELEASE MACHINES

FIELD OF THE INVENTION

The present invention relates to an improved release mechanism for core release machines, such an improvement focussing on a head driving device for coupling and uncoupling thereof from a blowing cartridge, in order to achieve a better function of the release mechanism.

BACKGROUND OF THE INVENTION

The release mechanism for core release machines that comprised the subject matter of Spanish patent application No. 8703409 corresponding to U.S. application Ser. No. 079,034, of the same applicant, has a bearing that can move toward the blowing cartridge, i.e, toward the cartridge containing the sand to be inserted in a core box. To such end said bearing is provided with two hollow guide-columns playing inside respective bushings, to which they are coupled closely, such bushings in turn extending into conduits connecting them to a small tank that supplies jet air, a release valve being provided in the bearing to allow discharge of the tank pressure towards the cartridge once the bearing has been duly coupled to such cartridge.

The purpose of said guide-columns is obviously to allow the bearing to retract or rise to facilitate sand substitution in the cartridge and subsequent displacement of the bearing toward the cartridge in order to tightly close the latter, at the stage when the jet air is released.

The above functions are carried out in said Spanish patent application with the assistance of a hydraulic cylinder ensuring efficient operation of the work cycles of the release mechanism.

However, it just to happens that when the core box is large and therefore has a large surface, once jet air has been released, there is a strong back pressure driving the blowing head, i.e., the said bearing, upwards, and the pressure inside the hydraulic cylinder is not enough to balance the said drive.

This results in an inadequate compacting of the cores, as a consequence of the pressure loss and an unwanted air leak dragging sand.

Thus, as a consequence of the back pressure ensuing on instantaneous jet air release, the tight coupling between the blowing head and the cartridge is broken, in given cases.

Although this problem does not arise when the core boxes are small on their closure is vertical, where the back pressure problem is negligible, this problem becomes important in the aforesaid cases, where the core box has a large surface.

SUMMARY OF THE INVENTION

It is an object of the present invention to fully solve the above probelm, wholly eliminating the problems deriving from the aforesaid back pressure effects and ensuring absolute stability of the bearing at all events.

More specifically and in order to achieve the above, the invention is drawn to a driving mechanism substituting the hydraulic cylinder of the above Spanish patent application No. 8703409 the U.S. counterpart of which matured into U.S. Pat. No. 4,807,690. The driving mechanism includes driving unit wherein a threaded cylinder is integral with the bearing, which threaded cylinder can move in the center of a sleeve or casing duly connected to the release mechanism chassis. The cylinder's complementary pin is driven by a motor also located in the casing, to which the pin transfers its load with the assistance of axial and radial rollers.

In accordance with the invention, operating the motor in either direction in turn causes the pin to turn in either direction, thereby imparting to the threaded cylinder an axial movement, which consequently drags the bearing in either direction, such mechanical transmission rendering a recoil effect of the bearing due to the back pressure that may ensue on release wholly impossible.

DESCRIPTION OF THE DRAWINGS

In order to complement the description being made and to assist a better understanding of the characteristics of the invention, a single figure of the drawings shows in an illustrative and non-limiting manner, a front elecation and quarter-sectional view of a release mechanism in accordance with the invention.

DESCRIPTION OF THE PREFERRED EMBODIMENT OF THE INVENTION

In the light of the drawing it may be observed that the release mechanism has, as aforementioned U.S. patent application, a pair of bushings 1 assembled on a chassis 2 of the release mechanism, in the center of which bushings play hollow guide-columns 3 that receive blowing air from a small tank that is not shown in the drawing and with the assistane of conduits 4 coupled to the bushings 1, such columns 3 being integral with a bearing or ram 5 where a top chamber 6 is defined into which columns 3 lead and where a release valve is formed, specifically through a valve seat 7, acted on by a piston 8 that is positioned in the middle portion of a cylindrical sleeve 9 being integral with a lid 10 of the bearing 5, whereas under the valve seat 7 is established a lower chamber 11 allowing, through a filter 12 and a hole 13, abrupt discharge pf air presseure from the small tank toward the sand cartridge, not shown in the drawing, after due coupling to the cartridge of the bearing front 14, provided with the corresponding water-tight joint.

Now, the invention set forth herein comprises providing, to substitute the hydraulic driving cylinder of the aforementioned U.S. patent application, a casing 15, duly connected through a flange 16 to the chassis 2. The casing 15 has a cylindrical guide surface 16'a for a threaded cylinder 17, of considerable axial dimension, fixed by means of screws 18 to the lid 10 of bearing 5 and consequently fixed to said bearing as a whole.

Inside the threaded cylinder 17 plays a pin 19, preferably with a ball thread, that shall provide the threaded cylinder 17 with the necessary longitudinal or axial movement to actuate the bearing or ram 5 in the normal operation of the release mechanism, i.e., for adaptation and separation of the bearing with respect to the sand cartridge in the manner described in the above application.

The pin 19, driven by a motor 20 fixed to the lid 21 of the casing 15, corresponding to the upper and free end thereof, has a perimetral extension 22 relatively close to the lid 21, specifically in correspondence with the diametral casing 15 extension, so that this extension 22 of the pin 19 determines a stepping to rest on an axial roller or bearing 23, through which the pin discharges the axial pull received on the lid 21 of the actual casing 15. Complementarily, and in correspondence with the same pin extension 22, the latter is assisted by a pair of radial rollers or bearing 24 that foster pin rotation.

In accordance with above-described structure and as aforesaid, the bearing or ram 5 can be driven wholly mechanically, specifically through the pin threaded cylinder 19–17 transmission, wherefore the bearing, when the motor 20 has caused it to couple to the sand cartridge, is kept wholly fixed, irrespective of the back pressure generated upon release.

I claim:

1. A release mechanism of a core blowing machine, comprising a hollow ram; means for reciprocally driving said ram to and from a blowing cartridge; a chassis and two hollow columns for supporting and guiding a movement of said ram; an air discharging valve defined in said ram; said driving means including a driving unit and a motor, said unit including threaded cylinder integral with said ram and a pin provided with a ball-type thread thereon and driven by said motor to move said threaded cylinder therealong upon rotation of said pin by said motor in either direction; a casing having a lid supporting said motor and integral with said chassis, said casing defining a cylindrical sleeve receiving and supporting said threaded cylinder in its movement, said pin in the region beyond a free end of said threaded cylinder having an annular expansion portion defining a stepping; an axial bearing resting on said stepping and transferring an axial thrust force from said pin to said lid; and a pair of radial bearings positioned at a periphery of said expansion portion and supporting said pin in said casing.

2. In a release mechanism of a core blowing machine, comprising a hollow ram; means for reciprocally driving said ram to and from a blowing cartridge; a chassis and two hollow columns connected to said columns at lower ends thereof and supporting and guiding a movement of said ram; and an air discharging valve defined in said ram, the improvement comprising said driving means including a driving unit and a motor, said unit including an elongated threaded cylinder integral with said ram and an elongated pin provided with a ball-type thread thereon and being connected to said motor to be driven by said motor to move said threaded cylinder therealong upon rotation of said pin by said motor in either direction; and a casing positioned between said columns and having a lid supporting said motor, said casing being integral with said chassis and including an elongated cylindrical sleeve portion constructed to receive said elongated threaded cylinder and supporting said threaded cylinder its movement in either direction.

3. The release mechanism according to claim 2, wherein said piin in the region beyond a free end of said threaded cylinder has an annular expansion portion defining a stepping; and further comprising an axial bearing resting on said stepping and transferring an axial thrust force from said pin to said lid, and a pair of radial bearings positioned at a periphery of said expansion portion and supporting said pin in said casing.

* * * * *